US006769519B2

(12) United States Patent
Velayutha

(10) Patent No.: US 6,769,519 B2
(45) Date of Patent: Aug. 3, 2004

(54) FLANGE LUBRICATOR ATTACHMENT TO A COMPOSITE BRAKE SHOE

(75) Inventor: Raj Velayutha, North Parromatta (AU)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 26 days.

(21) Appl. No.: 10/066,826

(22) Filed: Feb. 4, 2002

(65) Prior Publication Data

US 2003/0146051 A1 Aug. 7, 2003

(51) Int. Cl.[7] ..... F16D 69/00

(52) U.S. Cl. ..... 188/264 B; 188/264 R; 188/252

(58) Field of Search ..... 188/264 B, 264 R, 188/252, 253, 256, 245, 239, 238; 184/3.2, 99

(56) References Cited

U.S. PATENT DOCUMENTS 679,781 A * 8/1901 Power ..... 188/252
1,017,015 A * 2/1912 Perkins ..... 184/3.2
1,050,408 A * 1/1913 Vye ..... 188/238
1,219,463 A * 3/1917 Kinzer ..... 188/251 R
1,317,732 A * 10/1919 Schoenheiter ..... 188/253
4,915,195 A * 4/1990 Dial ..... 184/3.2
5,234,082 A * 8/1993 Christie ..... 188/250 G
5,794,740 A * 8/1998 Velayutha et al. ..... 188/251 A

* cited by examiner

*Primary Examiner*—Robert A. Siconolfi
(74) *Attorney, Agent, or Firm*—James Ray & Associates

(57) ABSTRACT

A device for lubricating a flange portion of a railroad wheel attachable to a composition brake shoe. The device comprises at least one lubricating member formed from a polymer based compound selected from the group consisting of phenolic resins, epoxy resins, polyamides, polytetrafluoroethenes, and various combinations thereof. The lubricating member has a substantially flat first side engageable with a longitudinal flat surface of such composition brake shoe and a radially opposed second side that has a substantially flat portion for contacting such flange portion of such railroad wheel. The device further includes a means for attaching the lubricating member or members to such composition brake shoe.

21 Claims, 4 Drawing Sheets

FLANGE LUBRICATOR ATTACHMENT TO A COMPOSITE BRAKE SHOE

FIELD OF THE INVENTION

The present invention relates, in general, to vehicle type braking equipment and, more particularly, this invention relates to a composition type brake block member for use in a railway type vehicle brake system and, even still more specifically, the present invention relates to a flange lubricator that is attached to such composition brake shoe for applying a substantially solid type lubricating film on the flange of such railroad wheel.

BACKGROUND OF THE INVENTION

Many railroad locomotives and cars use wheel tread braking which provides the braking effort required by forcing a brake shoe formed with a friction composition material against the tread of the steel wheel. Brake shoe engagement with the wheel tread produces friction that dissipates the energy of momentum in the form of heat. In order for such braking to be effective, however, wheel rotation is required. The adhesion due to the friction between the wheel tread and rail tends to maintain such wheel rotation as the brake shoe engages the wheel tread during a braking operation.

Excessive wheel wear and brake shoe change outs have been found to be cyclically high during the winter season. One theory attributes this, at least in part, to the more pronounced cleaning effect that the brake shoe has on the wheel as the result of higher moisture contact during wintertime. In that such cleaning action tends to increase the contact friction; or adhesion between the wheel and rail, increased contact stresses are created in the wheel. Such contact stresses being especially high during the guiding and steering action of the wheel set, particularly, when encountering track curvature. Similar problems of wear are also a concern with the flange portion of the wheel. These stresses can be reduced with lubrication.

Wayside lubricators have been a part of railroading for many years. These are placed in curved territory to reduce wheel and flange wear particularly where the wear is the greatest on the curved portions of the track. Emphasis has shifted in recent years to on board lubricators which are locomotive mounted units that are designed to provide lubrication on tangent track as well as in the curved territory in an effort both to reduce wear and also to improve fuel consumption.

Thus, the railroad industry is constantly trying to find methods and/or equipment that can be used to reduce the wear that occurs on both the wheel surface that contacts the rail and also the flange portion and at the same time possibly decrease fuel consumption by providing improved lubricity.

SUMMARY OF THE INVENTION

The present invention provides a device for lubricating a flange portion of a railroad wheel attachable to a composition brake shoe. The device comprises at least one lubricating member formed from a polymer based compound selected from the group consisting of phenolic resins, epoxy resins, polyamides, polytetrafluoroethenes, and various combinations thereof. The at least one lubricating member has a first predetermined shape, wherein the first predetermined shape has a substantially flat first side engageable with a longitudinal flat surface of such composition brake shoe and a radially opposed second side that has a substantially flat portion for contacting such flange portion of such railroad wheel and a substantially arcuate portion for contacting the arcuate interface of such flange portion and a tread portion of such railroad wheel. The device further includes a means for attaching the lubricating member or members to such composition brake shoe.

In another embodiment of the invention a device is in combination with a brake block of a railway vehicle having a backing plate and a brake lining affixed to said backing plate and further having a braking surface engageable with a wheel tread of a wheel of such railway vehicle, said brake lining formed from a predetermined composition material. The improvement comprises the device for lubricating a flange portion of such railroad wheel. The device is attachable to the brake lining of such brake block. The device comprises at least one lubricating member formed from a polymer based compound selected from the group consisting of phenolic resins, epoxy resins, polyamides, polytetrafluoroethenes, and various combinations thereof. The at least one lubricating member has a first predetermined shape, wherein the first predetermined shape has a substantially flat first side engageable with a longitudinal flat surface of such composition brake shoe and a radially opposed second side that has a substantially flat portion for contacting such flange portion of such railroad wheel and a substantially arcuate portion for contacting the arcuate interface of such flange portion and a tread portion of such railroad wheel. The device further includes a means for attaching the lubricating member or members to such composition brake shoe.

OBJECTS OF THE INVENTION

It is, therefore one of the primary objects of the present invention to provide a method of lubricating the flange portion of a railroad wheel with a solid lubricant.

It is also an object of the present invention to provide a method of lubricating the flange portion of a railroad wheel that does not require the use of an extraneous lubricating system.

Yet, another object of the present invention is to provide a method of lubricating the flange portion of a railroad wheel that is easy to install.

Still another object of the present invention is to provide a method of lubricating the flange portion of a railroad wheel that is inexpensive to manufacture and operate.

These and various other objects and advantages of this invention will become apparent after a full reading of the following detailed description, particularly, when read in conjunction with the attached drawings as described below and the appended claims.

Figure 1:
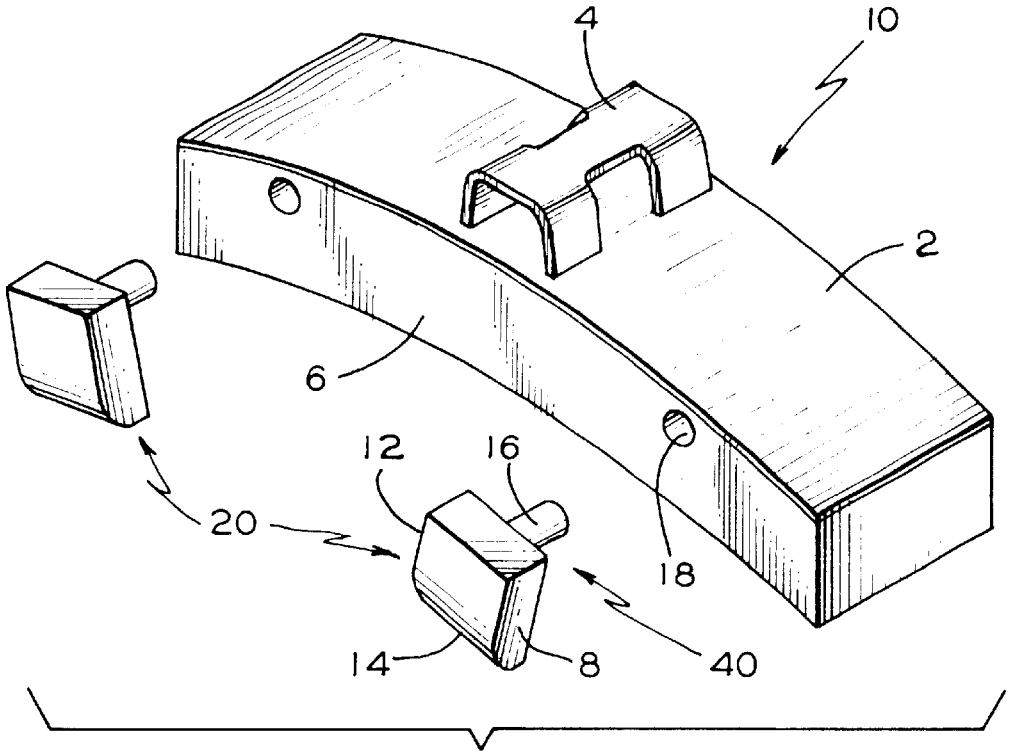
FIG. 1 is a perspective view of a brake shoe and the lubricating member prior to attachment.
Figure 2:
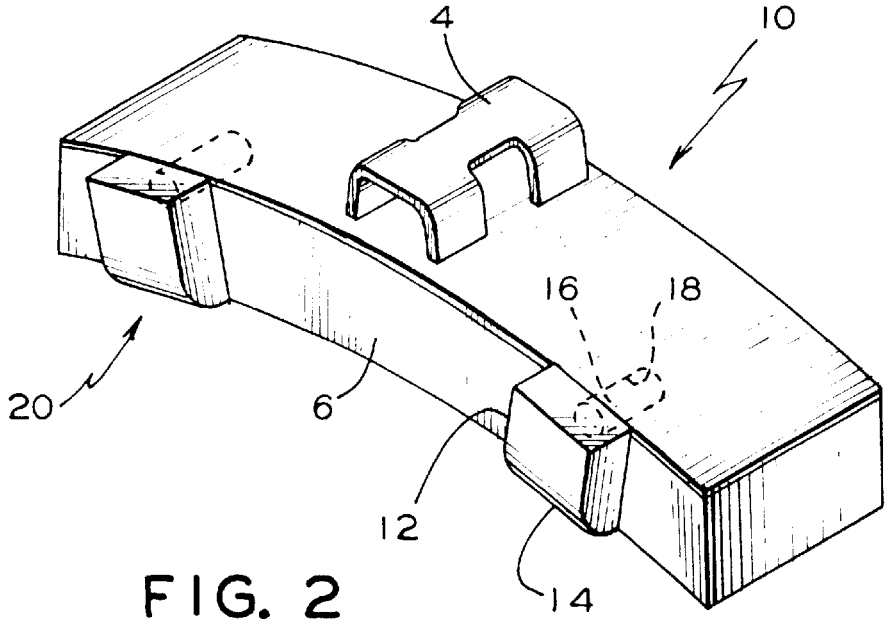
FIG. 2 is a perspective view of a brake shoe with the lubricating member attached thereto.
Figure 4:
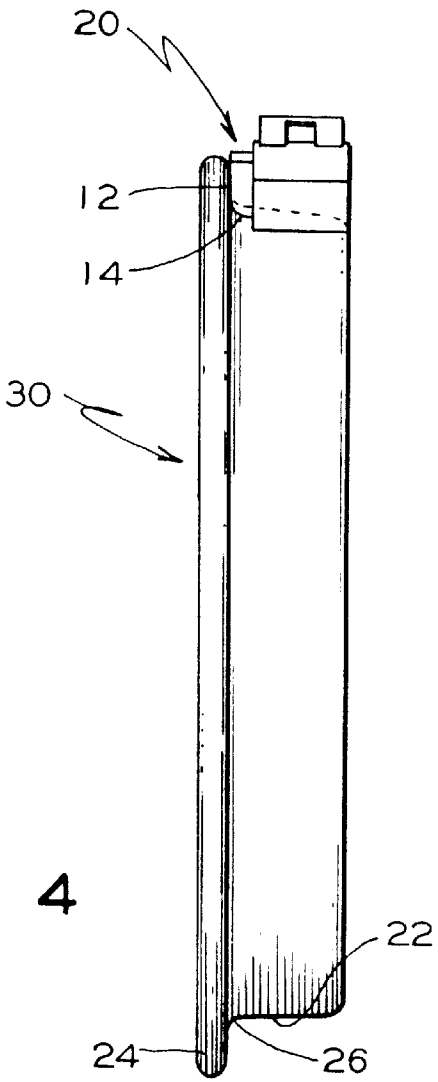
FIG. 4 is a side view of railroad wheel and a brake shoe showing the lubricating member contacting the flange and the arcuate interface between the flange and wheel tread.
Figure 3:
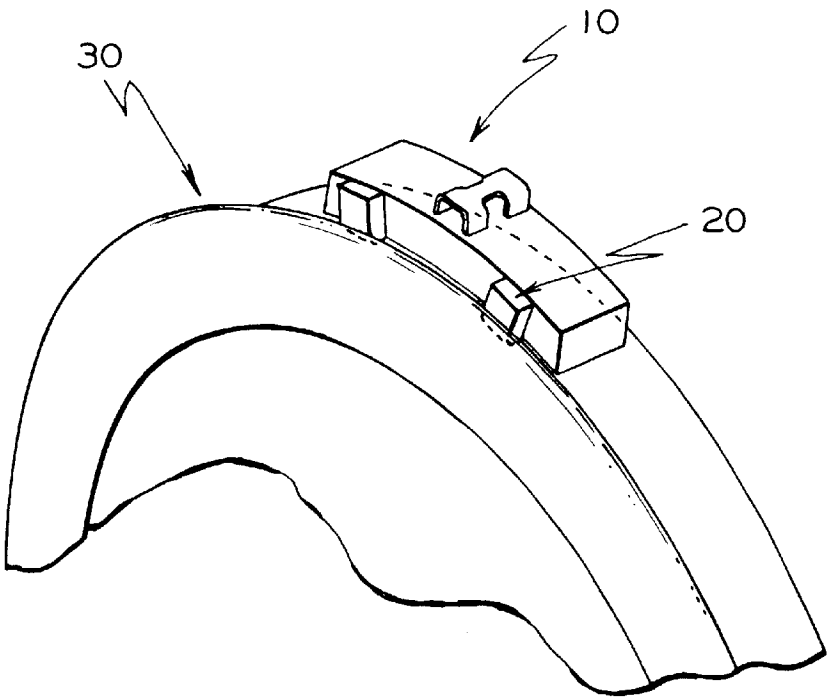
FIG. 3 is a perspective view of a railroad wheel and flange showing a brake shoe with the lubricating attachment.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Illustrated in the drawing Figures are various views of a brake shoe, generally designated 10 and a lubricating member or members, generally designated 20. Such brake shoe 20 comprises a backing plate 2 and a keybridge 4 for affixing the brake shoe 10 to a brake head (not shown) by conventional means such as a brake shoe key (also not shown). Affixed to such backing plate 2 is a molded brake block 6. Such brake block 6 is preferably a composition type molded brake lining, as opposed to iron or wooden brake blocks.

Figure 5:
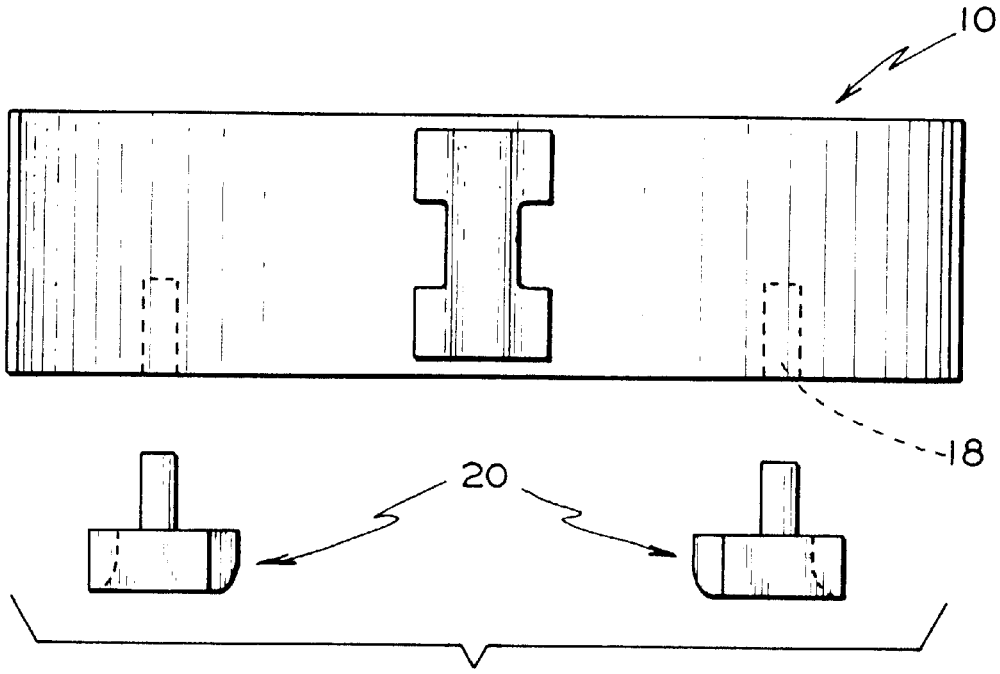
FIG. 5 is a top view of a brake shoe and the lubricating member prior to attachment.
Figure 6:
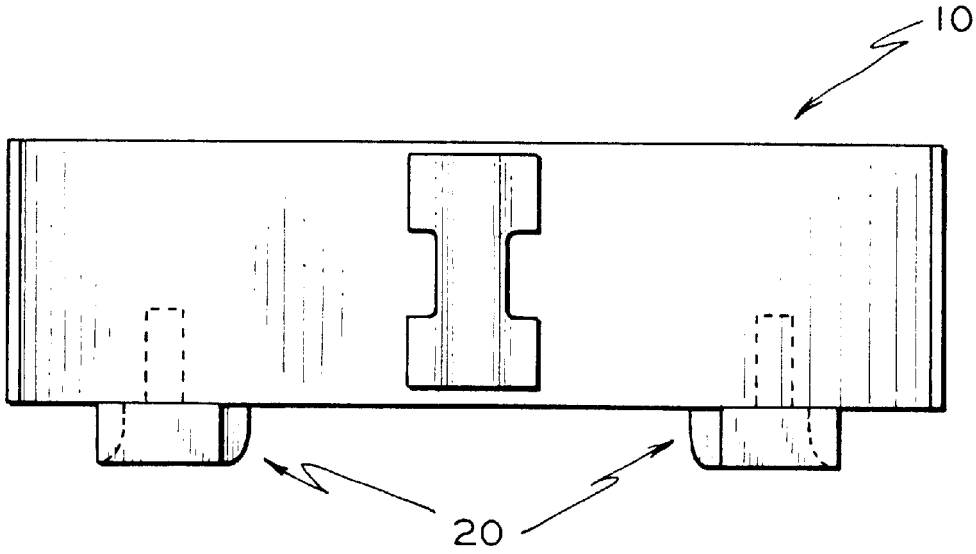
FIG. 6 is a top view of a brake shoe with the lubricating members attached thereto.
Figure 7:
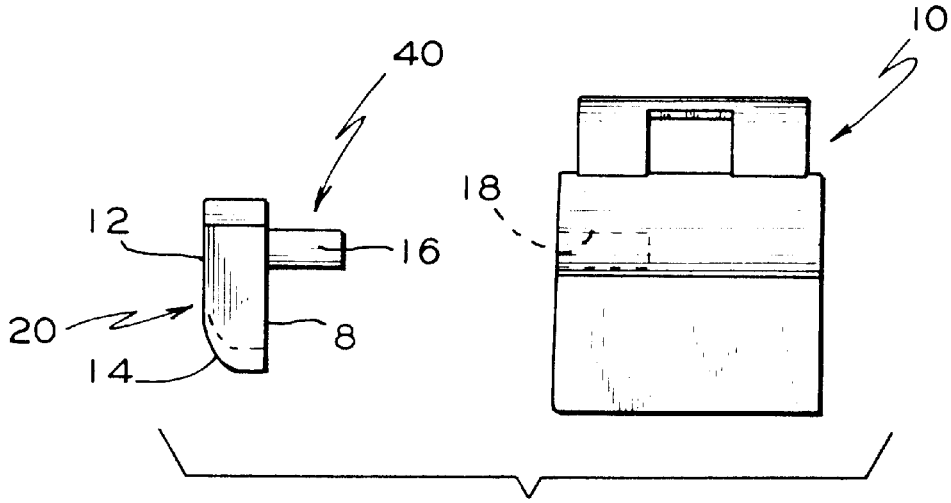
FIG. 7 is an end of a brake shoe and the lubricating member prior to attachment.
Figure 8:
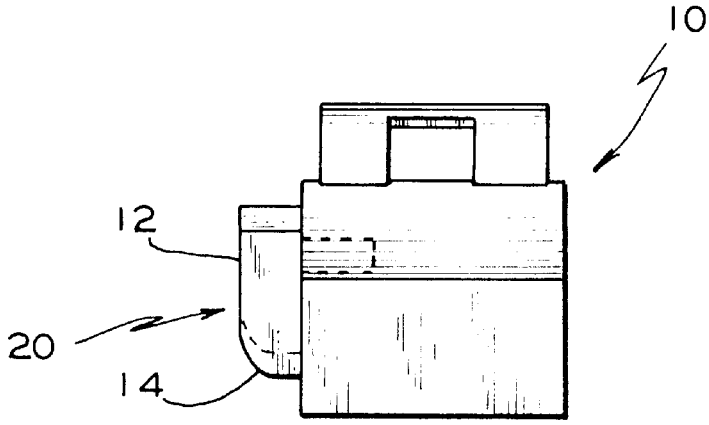
FIG. 8 is an end view of a brake shoe with the lubricating member attached thereto.

Also shown in the various drawing Figures is lubricating member 20. FIGS. 1, 5 and 7 show lubricating member 20 not attached to the brake block 6, while FIGS. 2,3,4,6,8 and 9 show various views of the lubricating member 20 or members attached to the brake lining 6. Such lubricator attachment 20 is a molded component that can be attached to the brake shoe 10 at the time of fitment at the railway depot.

Such lubricating member 20 is formed from a polymer based compound. Such polymer based compound is selected from the group consisting of phenolic resins, epoxy resins, polyamides, polytetrafluoroethenes, and various combinations thereof. In a presently preferred embodiment of the invention such polymer based lubricating member is formed from a phenolic resin. It is also preferred that such phenolic resin be a cashew modified resin. Further, in the most preferred embodiment of the invention such phenolic resin contains molybdenum disulfide.

Figure 9:
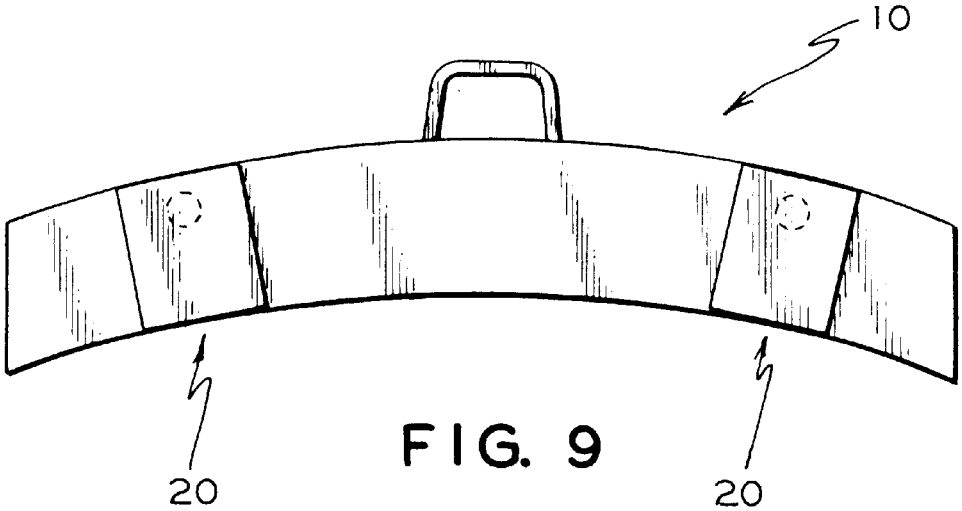
FIG. 9 is a side view of a brake shoe with the lubricating member attached thereto.

Such lubricating member 20 can be molded or cast into any shape that is required. The presently preferred shape of such lubricating member 20 has a substantially flat first side 8 that is engageable with a longitudinal flat surface of such composition brake lining 6. Lubricating member 20 has a radially opposed second side that has a substantially flat portion 12 for contacting such flange portion 24 (shown only in FIGS. 3 and 4) of such railroad wheel, generally designated 30 and a first substantially arcuate portion 14 for contacting the arcuate interface 26 of such flange portion 24 and the tread portion 22 of such railroad wheel. Such lubricating member 20 has a second substantially arcuate portion 28 formed on the bottom surface of such lubricating member 20. Such second substantially arcuate portion 28 is formed on a bottom surface of said lubricating member in a longitudinal direction to mate with the curvature of the railroad wheel. This is seen in FIG. 9. Also it is presently preferred that there are two lubricating members 20 on each brake block 6.

The lubricating member 20 further has a means, generally designated 40, for attaching such lubricating member 20 to the brake lining 6 of the composition brake shoe 10. It is presently preferred that such means 40 be a projection 16 disposed substantially perpendicular to the substantially flat first side 8 of the lubricating member 20. Further it is preferred that such projection 16 have a cylindrical shape. It is further preferred that projection 16 be disposed in a similar cylindrical aperture 18 formed in the brake lining 6. Such projection 16 is attached to the brake lining 6 by means of at least one of a friction fit, an adhesive and a screw. It is presently preferred that such lubricating member 20 be attached to the brake lining 6 by utilizing both a friction fit and an adhesive.

Such lubricating member 20 when attached to the brake lining 6 will provide lubrication for the flange portion of the railroad wheel by transferring solid lubricant to the flange as wheel rotates and the flange comes in contact with the lubricating member 20. After the lubricating member has been worn away to the point where it no longer contacts the flange it can be discarded and replaced with a new lubricating member.

The main use of this flange lubricator is to transfer the polymer based compound onto the flange and vicinity of the flange of a railroad wheel used by all types of railway rolling stock. The deposit of the polymer compound alters the friction between the flange of the railway wheel and the rail, especially at track curvatures. The polymer based compound deposited on the flange will substantially minimize flange wear.

While both the presently preferred and a number of alternative embodiments of the present invention have been described in detail above it should be understood that various other adaptations and modifications of the present invention can be envisioned by those persons who are skilled in the relevant art of railway braking systems without departing from either the spirit of the invention or the scope of the appended claims.

I claim:

1. A device for lubricating a flange portion of a railroad wheel engageable with a molded brake block of a brake shoe, said device comprising:

(a) at least one lubricating member for altering friction between said flange portion of such railroad wheel and a rail formed from a polymer based compound selected from the group consisting of phenolic resins, epoxy resins, polyamides, polytetrafluoroethenes, and various combinations thereof, said at least one lubricating member having a first predetermined shape; and (b) a means secured to a predetermined portion of an inner surface of said at least one lubricating member and with a surface of said molded brake block which confronts such flange portion of such railroad wheel for attaching said at least one lubricating member to said brake block of such brake shoe.

2. A device for lubricating a flange portion of a railroad wheel, according to claim 1, wherein said first predetermined shape includes a top surface and a bottom surface and further includes a substantially flat first side engageable with a longitudinal flat surface of said molded brake block of such brake shoe and a radially opposed second side having a substantially flat portion adjacent said top surface for contacting at least a portion of such flange portion of such railroad wheel.

3. A device for lubricating a flange portion of a railroad wheel, according to claim 2, wherein said first predetermined shape further includes a substantially arcuate portion disposed on said radially opposed second side between said substantially flat portion and said bottom surface for contacting an arcuate interface of such flange portion and a tread portion of such railroad wheel.

4. A device for lubricating a flange portion of a railroad wheel, according to claim 3, wherein said first predetermined shape further includes a substantially concave portion, said substantially concave portion formed on said bottom surface of said lubricating member in a longitudinal direction.

5. A device for lubricating a flange portion of a railroad wheel, according to claim 4, wherein said means for attaching said at least one lubricating member to said molded brake block of such brake shoe includes at least one projection disposed substantially perpendicular to said substantially flat first side, said projection having a second predetermined shape.

6. A device for lubricating a flange portion of a railroad wheel, according to claim 5, wherein said second predetermined shape of said projection is cylindrical.

7. A device for lubricating a flange portion of a railroad wheel, according to claim 6, wherein said cylindrical projection is disposed in a cylindrical aperture formed in a longitudinal surface of said molded brake block of such brake shoe.

8. A device for lubricating a flange portion of a railroad wheel, according to claim 1, wherein said means for attaching said at least one lubricating member to said molded brake block of such brake shoe is at least one of a friction fit, and an adhesive.

9. A device for lubricating a flange portion of a railroad wheel, according to claim 1, wherein said polymer based compound is a phenolic resin.

10. A device for lubricating a flange portion of a railroad wheel, according to claim 9, wherein said phenolic resin includes a cashew modified phenolic resin.

11. A device for lubricating a flange portion of a railroad wheel, according to claim 9, wherein said phenolic resin further includes molybdenum disulfide.

12. A device for lubricating a flange portion of a railroad wheel, according to claim 1, wherein said device includes at least two lubricating members.

13. A device for lubricating a flange portion of a railroad wheel, according to claim 1, wherein said brake block is a composition brake block of such brake shoe.

14. In combination with a brake shoe of a railway vehicle having a backing plate and a molded brake block affixed to said backing plate and further having a braking surface engageable with a wheel tread of a wheel of such railway vehicle, said molded brake block formed from a predetermined material; the improvement comprising a device engageable with said brake block for lubricating a flange portion of such railroad wheel, said device comprising:

(a) at least one lubricating member for altering friction between said flange portion of such railroad wheel and a rail formed from a polymer based compound selected from the group consisting of phenolic resins, epoxy resins, polyamides, polytetrafluoroethenes, and various combinations thereof, said at least one lubricating member having a first predetermined shape; and (b) a means secured to a predetermined portion of an inner surface of said at least one lubricating member and with a surface of said molded brake block which confronts such flange portion of such railroad wheel for attaching said at least one lubricating member to said brake block of such brake shoe.

15. The combination, according to claim 14, wherein said first predetermined shape includes a top surface and a bottom surface and further includes a substantially flat first side engageable with a longitudinal flat surface of said molded brake block of such brake shoe and a radially opposed second side having a substantially flat portion adjacent said top surface for contacting at least a portion of such flange portion of such railroad wheel.

16. The combination, according to claim 15, wherein said first predetermined shape further includes a substantially arcuate portion disposed on said radially opposed second side between said substantially flat portion and said bottom surface for contacting an arcuate interface of such flange portion and a tread portion of such railroad wheel.

17. The combination, according to claim 16, wherein said first predetermined shape further includes a substantially concave portion, said substantially concave portion formed on said bottom surface of said lubricating member in a longitudinal direction.

18. The combination, according to claim 14, wherein said means for attaching said at least one lubricating member to said molded brake block includes at least one projection disposed substantially perpendicular to said substantially flat first side, said projection having a second predetermined shape.

19. The combination, according to claim 18, wherein said second predetermined shape of said projection is cylindrical.

20. The combination, according to claim 19, wherein said cylindrical projection is disposed in a cylindrical aperture formed in a longitudinal surface of said molded brake block.

21. The combination, according to claim 14, wherein said means for attaching said at least one lubricating member to said composition brake shoe is at least one of a friction fit, and an adhesive.

* * * * *